United States Patent [19]

Zusman

[11] 4,156,995

[45] Jun. 5, 1979

[54] CANTILEVERED CROSS TRUSS CONSTRUCTION

[76] Inventor: Bertram Zusman, 570 Madera Ave., Youngstown, Ohio 44504

[21] Appl. No.: 916,294

[22] Filed: Jun. 16, 1978

[51] Int. Cl.[2] ..... E04B 1/34

[52] U.S. Cl. ..... 52/73; 52/262; 52/667; 52/693

[58] Field of Search ..... 52/693, 73, 694, 665, 52/667, 262, 289

[56] References Cited

U.S. PATENT DOCUMENTS

| | | | |
|---|---|---|---|
| 1,871,041 | 8/1932 | Cavanagh | 52/665 X |
| 1,911,018 | 5/1933 | Goeltz | 52/648 |
| 3,063,103 | 11/1962 | Rylander | 52/73 |
| 3,410,036 | 11/1968 | Brell | 52/73 X |
| 3,477,189 | 11/1969 | Merson | 52/665 X |

FOREIGN PATENT DOCUMENTS

| | | | |
|---|---|---|---|
| 1221815 | 1/1960 | France | 52/694 |

OTHER PUBLICATIONS

Architectural Record NA 1. A66, Oct. 1943, p. 11.

*Primary Examiner*—Alfred C. Perham
*Attorney, Agent, or Firm*—Webster B. Harpman

[57] ABSTRACT

A cantilivered cross truss construction provides a load supporting structure through the interlocking of the trusses one within the other to form a superior load supporting truss construction.

6 Claims, 4 Drawing Figures

CANTILEVERED CROSS TRUSS CONSTRUCTION

BACKGROUND OF THE INVENTION (1) Field of the Invention

This invention relates to load supporting structures of a truss configuration.

(2) Description of the Prior Art

Prior structures of this type have utilized truss construction for integral load supporting assemblies. See for example U.S. Pat. Nos. 1,911,018, 3,410,036 and 3,477,189.

In U.S. Pat. No. 1,911,018 a plurality of different shaped truss chords all having the same height are disclosed and welded to one another at each truss intersection forming a box-like support structure.

In the present invention a cantilivered cross truss system is disclosed having similar trusses of different heights forming an open ended cantiliver system.

In U.S. Pat. No. 3,410,036 a multi-purpose roof structure is disclosed formed of elongated bridge members with chord members all of the same height supported by hydraulic means.

In the present invention a cross truss system is disclosed having pairs of truss members of two different heights, one placed inside the other for a cantilivered support system secured by a series of reinforcing and spacing tie-downs to a foundation wall.

In U.S. Pat. No. 3,477,189, a load supporting structure is disclosed comrising two series of interlocking trusses wherein one truss member has a series of gaps in the upper chord so that the other truss can be lowered into the same and locked in place by a special bracket fitted on the top chord of the second truss.

In the present invention two truss members with uninterupted upper and lower chords are placed at right angles through one another achieving a self-supporting cantilivered structure in a cross shape.

SUMMARY OF THE INVENTION

A cantilivered cross truss construction wherein a series of pairs of two different sized truss members are placed at right angles, one within the other, forming a spaced self-supporting truss construction whose ends are cantilivered extending past the foundation walls. The truss members are preferably made of wood.

DESCRIPTION OF THE PREFERRED EMBODIMENT

Figure 2:
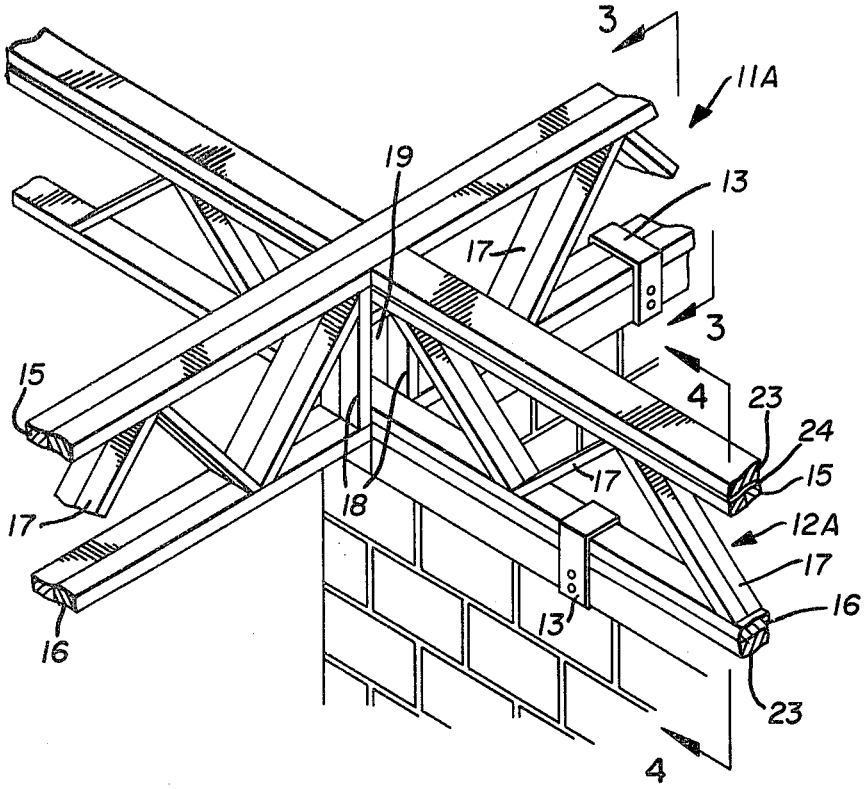
FIG. 2 is an enlarged perspective view of a portion of the truss construction.
Figure 1:
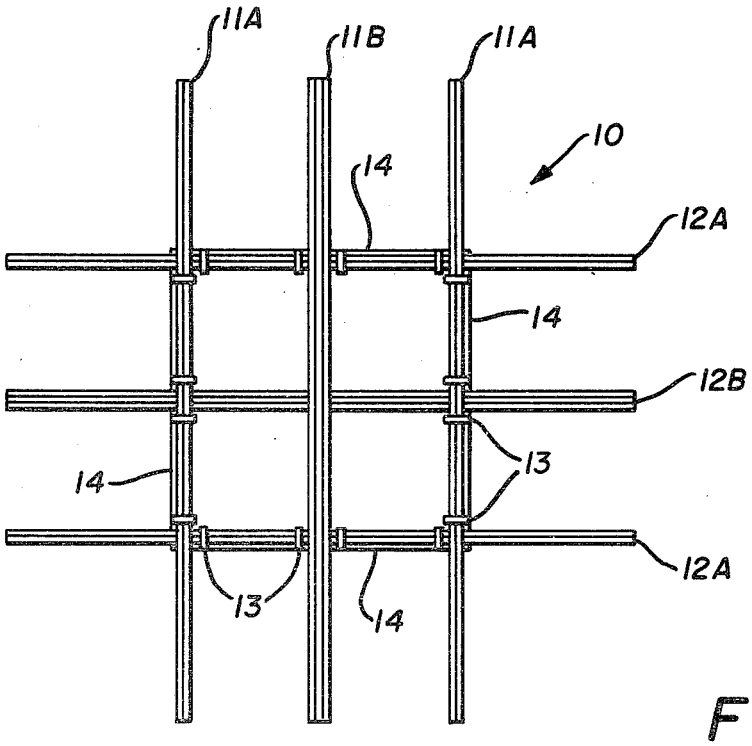
FIG. 1 is a top plan view of the cantilivered cross truss construction.

Referring to FIGS. 1 and 2 of the drawings, a cantilivered cross truss construction 10 is shown comprising multiple truss members 11A and 11B, 12A and 12B, a plurality of tie-down straps 13 and a foundation wall 14.

Referring now to FIG. 2 of the drawings, an enlarged portion of the truss construction 10 can be seen wherein the truss members 11A and 11B, 12A and 12B have upper and lower chords 15 and 16 with a plurality of chord connecting web members 17 that run alternately from each chord member 15 and 16 in an angular pattern. Truss members 11A and 11B have a series of vertical chord connecting members 18, pairs of which form vertical openings 19 between the angularly running chord connecting web members 17. The truss members 12A and 12B are of a height so that they can be positioned through the vertical openings 19 in the truss members 11A and 11B at each location where the trusses 11A and 11B cross the trusses 12A and 12B.

Figure 3:
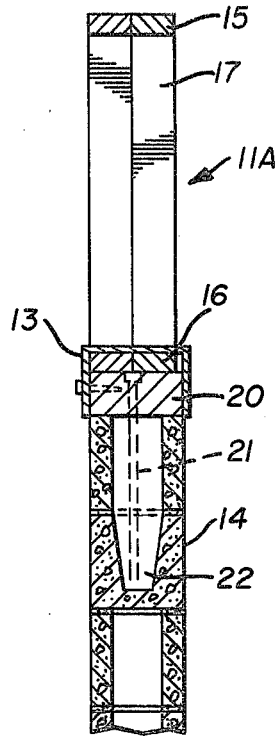
FIG. 3 is a section on line 3—3 of FIG. 2.

As shown in FIG. 3 of the drawings, the lower chord 16 of the truss member 11A is secured to a plate 20 by the tie-down strap 13. An anchor rod 21 runs through the plate 20 into the foundation wall 14 which is reinforced with concrete 22.

Figure 4:
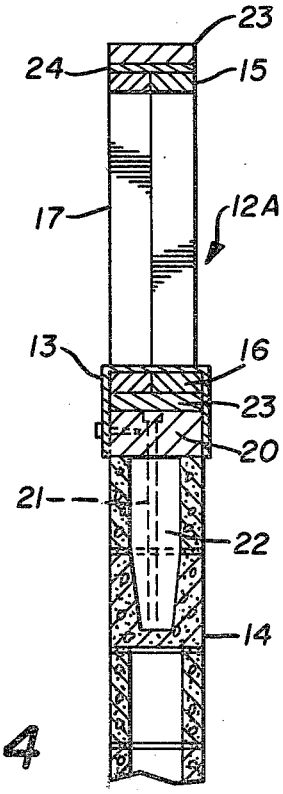
FIG. 4 is a section on line 4—4 of FIG. 2.

In FIG. 4 of the drawings, the lower chord 16 of the truss member 12A is secured to the plate 20 and a reinforcing spacer plate 23 by the tie-down strap 13. The plate 20 is secured to the foundation wall 14 by an anchor rod 21 that extends down into concrete 22 in the foundation wall 14.

In FIGS. 2 and 4 of the drawings it will be seen that the truss member 12A includes the spacer plates 22 and 23 and a filler strip 24 to compensate for the vertical height differential between the truss members 12A and 11A. The spacer plates 22 and 23 also reinforce the chords of the truss.

It will thus be seen that the cantilevered self-supporting construction is achieved by the interlacing of the basic truss members 11A and 11B and 12A and 12B.

Referring to FIG. 1 of the drawings, it will be seen that the truss members 11B and 12B are preferably made of three separate truss units formed of two by fours joined together to form a basic cross support across the foundation wall 14. The tie-down straps 13 are placed on either side of the truss intersections along the perimeter of the foundation wall 14 to help secure the cantilevered truss construction 10 to the foundation wall 14. The truss members 12A and 12B are preferably made of two separate truss units formed of two by fours joined together.

It will thus be seen that a new and novel cross truss construction has been disclosed which can be simply and inexpensively built to form a self-supporting cantilevered structure allowing greater utilization of building materials and a shortened building time. The structure is particularly useful in pedestal homes and like.

Although but one embodiment of the present invention has been illustrated and described, it will be apparent to those skilled in the art that various changes and modifications may be made therein without departing from the spirit of the invention and having thus described my invention,

What I claim is:

1. A load supporting cantilevered cross truss construction comprising several pairs of crossed horizontally disposed truss members, each member including vertically spaced top and bottom chord members and interconnecting web members, one of each pair of truss members being of a greater height than the other so that one truss member of each pair passes through an opening in the other, reinforcing members longitudinally of said other truss member so as to increase the height thereof to that of said higher truss members and means for securing said cross truss members to a foundation inwardly of the ends of said crossed truss members.

2. The load supporting cantilevered cross truss construction of claim 1 and wherein the cross truss members are made of several individual trusses secured to one another in side by side relation.

3. The load supporting cantilevered cross truss construction of claim 1 and wherein most of said interconnecting web members are angularly disposed between the top and bottom chord members and several of said web members are arranged in horizontally spaced pairs to form said openings.

4. The load supporting cantilevered cross truss construction of claim 2 wherein said reinforcing members join said individual trusses and are fastened thereto.

5. The load supporting cantilevered cross truss construction of claim 1 wherein said means for securing said cross truss members to the foundation comprise a plurality of tie-down straps and plates on the foundation wall.

6. The load supporting cantilevered cross truss construction of claim 1 wherein said chord members and interconnecting web members are wood.

* * * * *